US009062501B2

(12) United States Patent
Begley et al.

(10) Patent No.: US 9,062,501 B2
(45) Date of Patent: Jun. 23, 2015

(54) DOWNHOLE CENTRALISER

(75) Inventors: Aaron Begley, Henderson (AU); Peter Brendon Thomas Pezet, Henderson (AU)

(73) Assignee: Matrix Composites & Engineering Limited, Wattleup, Western Australia (AU)

( * ) Notice: Subject to any disclaimer, the term of this patent is extended or adjusted under 35 U.S.C. 154(b) by 661 days.

(21) Appl. No.: 13/274,751

(22) Filed: Oct. 17, 2011

(65) Prior Publication Data

US 2012/0138289 A1 Jun. 7, 2012

(30) Foreign Application Priority Data

Dec. 1, 2010 (AU) ..... 2010905284

(51) Int. Cl.
*E21B 19/24* (2006.01)
*E21B 17/10* (2006.01)

(52) U.S. Cl.
CPC ..... *E21B 17/1042* (2013.01)

(58) Field of Classification Search
CPC ..... E21B 17/10; E21B 17/1078; E21B 19/24
USPC ..... 166/241.1, 241.6; 175/325.1, 325.5
See application file for complete search history.

(56) References Cited

U.S. PATENT DOCUMENTS

| | | | | |
|---|---|---|---|---|
| 3,044,554 | A * | 7/1962 | Kluck | 166/241.6 |
| 3,613,783 | A | 10/1971 | Seabourn | |
| 3,963,075 | A | 6/1976 | Evans | |
| 4,441,557 | A | 4/1984 | Zublin | |
| 4,984,633 | A | 1/1991 | Langer et al. | |
| 5,797,455 | A | 8/1998 | Barron et al. | |
| 5,908,072 | A * | 6/1999 | Hawkins | 166/241.6 |
| 6,006,830 | A | 12/1999 | Barron et al. | |
| 6,401,820 | B1 | 6/2002 | Kirk et al. | |
| 6,435,275 | B1 | 8/2002 | Kirk et al. | |
| 6,446,725 | B2 | 9/2002 | Cabot | |
| 6,659,173 | B2 | 12/2003 | Kirk et al. | |
| 6,830,102 | B2 | 12/2004 | Kirk et al. | |
| 6,845,816 | B2 | 1/2005 | Kirk et al. | |
| 7,096,939 | B2 | 8/2006 | Kirk et al. | |
| 7,694,733 | B2 | 4/2010 | Clark et al. | |
| 2003/0164236 | A1 * | 9/2003 | Thornton | 166/278 |

FOREIGN PATENT DOCUMENTS

| | | | |
|---|---|---|---|
| GB | 2249333 | A | 5/1992 |
| GB | 2285649 | A | 7/1995 |

* cited by examiner

*Primary Examiner* — Catherine Loikith
(74) *Attorney, Agent, or Firm* — Ohlandt, Greeley, Ruggiero & Perle, L.L.P.

(57) ABSTRACT

A downhole centralizer arranged to receive a downhole tubular has a tubular body with opposed ends and is formed of plastics material A respective end ring is mounted in the or each opposed end and is formed of a plastics material having a Youngs Moldulus no greater than that of the tubular body.

20 Claims, 4 Drawing Sheets

DOWNHOLE CENTRALISER

FIELD

The present invention relates to a downhole centraliser.

BACKGROUND

It is known to provide downhole tubulars in oil or gas wells and the like with centralisers so as to space and centralise the downhole tubular relative to an open hole or an outer casing of a downhole. The centraliser reduces the possibility of the downhole tubular contacting the outer casing whilst assisting in matching of consecutive tubulars in the borehole.

It has been found that centralisers containing metal components can have problems with galvanic interaction between the centralisers and the downhole tubular in use.

SUMMARY

The present invention provides a downhole centraliser which is composed entirely of plastics material and therefore avoids problems of galvanic interaction encountered with some prior art centralisers.

In accordance with one aspect of the present invention there is provided a downhole centraliser arranged to receive a downhole tubular comprising a tubular body having opposed ends and being formed of plastics material, and at least one end ring mounted to an end of the tubular body, the or each end ring also being formed of a plastics material and having a Youngs modulus no greater than that of the tubular body.

Preferably, a respective end ring is mounted to each of the opposed ends of the tubular body.

The tubular body of the centraliser of the present invention is preferably formed of plastics materials such as thermoplastic compounds, fibre reinforced thermoplastic, thermoset plastic, fibre reinforced thermoset plastic. The or each end ring is preferably formed of the same plastics material.

The or each end ring may fit into the tubular body by means of an interference fit. However, means may be provided for positively engaging the or each end ring with the tubular body.

Further, the or each end ring may have an inner face that is formed with a plurality of inwardly extending projections. The inwardly extending projections are arranged in use to bear on a tubular member about which the centraliser is mounted.

BRIEF DESCRIPTION OF DRAWINGS

The present invention will now be described, by way of example, with reference to the accompanying drawings, in which.

DESCRIPTION OF EMBODIMENTS

Figure 1:
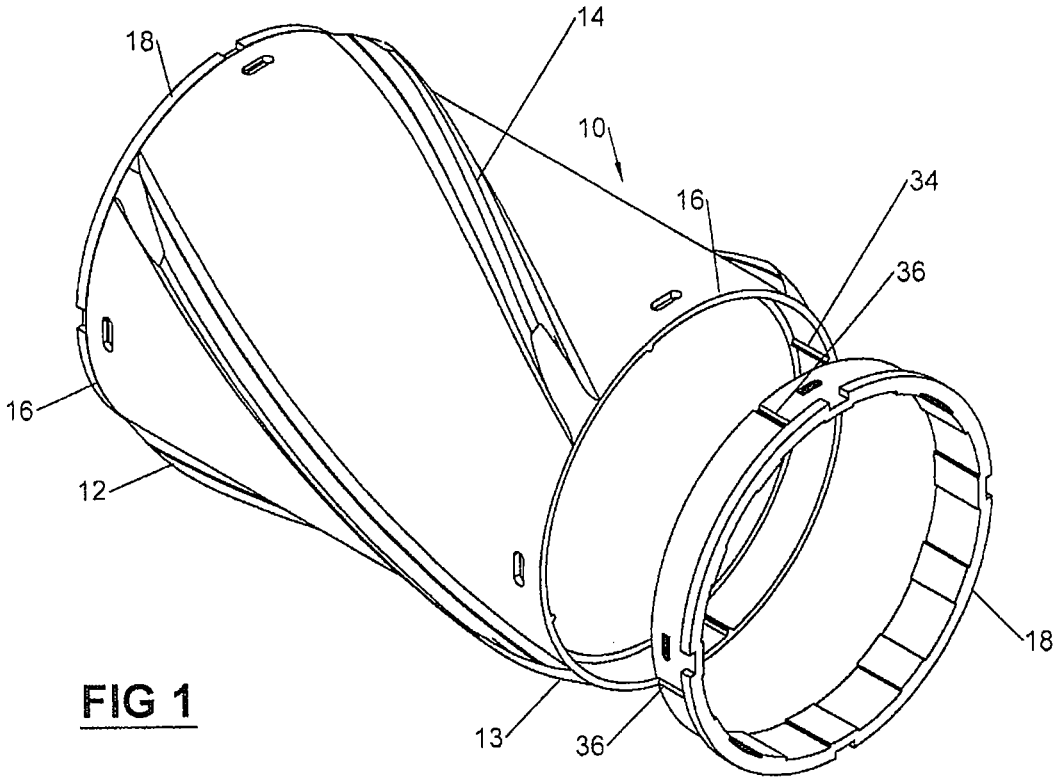
FIG. 1 is a perspective view of a downhole centraliser in accordance with the present invention showing a first end ring installed and a second end ring spaced apart.
Figure 2:
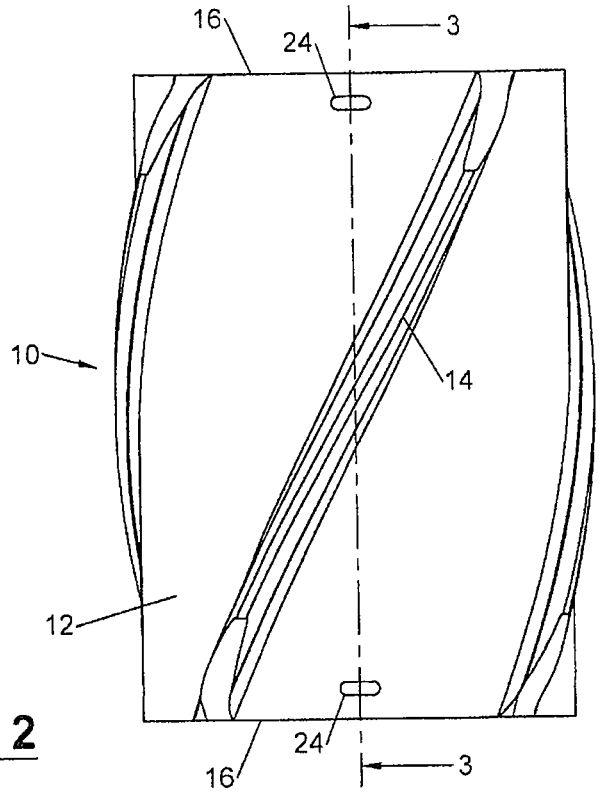
FIG. 2 is a side elevation of a tubular body of the centraliser of FIG. 1.

In the drawings there is shown a downhole centraliser 10 comprising a generally cylindrical tubular body 12 formed of plastics material. The body 12 has an external surface 13. As can be seen the body 12 has a plurality of longitudinal spiral or straight blades 14 disposed on the external surface 13 thereof. The blades 14 are arranged to engage in use with internal surfaces of casing members in a downhole well. Preferably, the body 12 is substantially rigid. Further, the blades 14 may be integrally formed with the body 12. Still further, the body may be conveniently manufactured by moulding.

Figure 3:
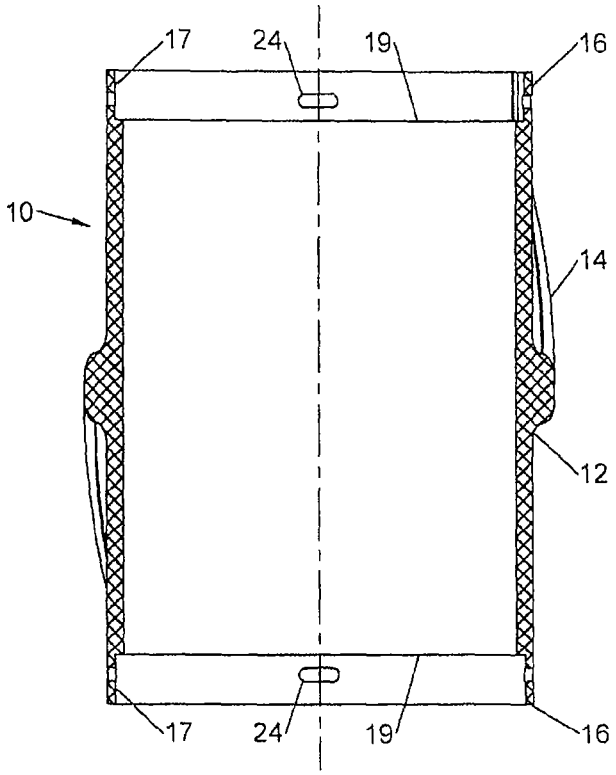
FIG. 3 is a cross-section taken along the line 3-3 of FIG. 2.

Further, as can be seen in FIG. 3, the body 12 is formed with opposed ends 16. As can be seen in FIG. 3 each end 16 of the body 12 is provided with a relatively thin wall section 17 arranged to receive an end ring 18 to be described.

Figure 5:
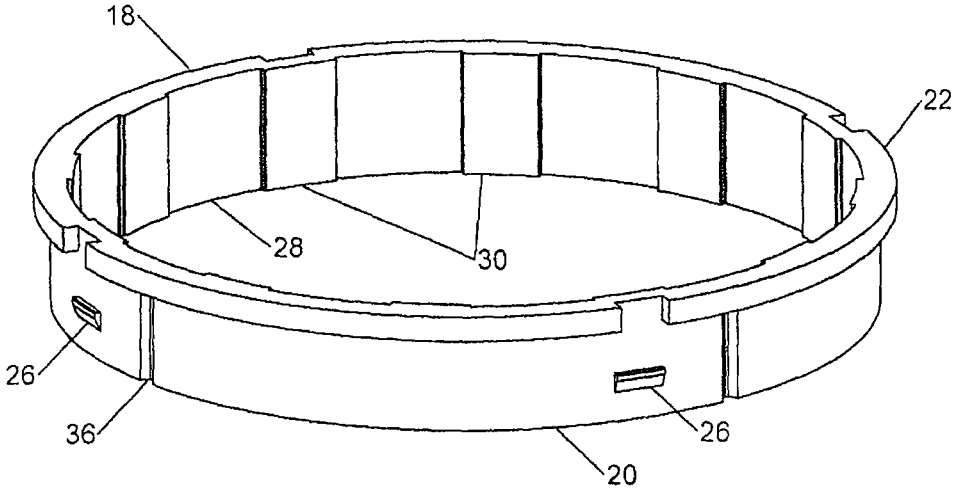
FIG. 5 is a perspective view of an end ring of the centraliser of FIGS. 1 to 4.
Figure 6:
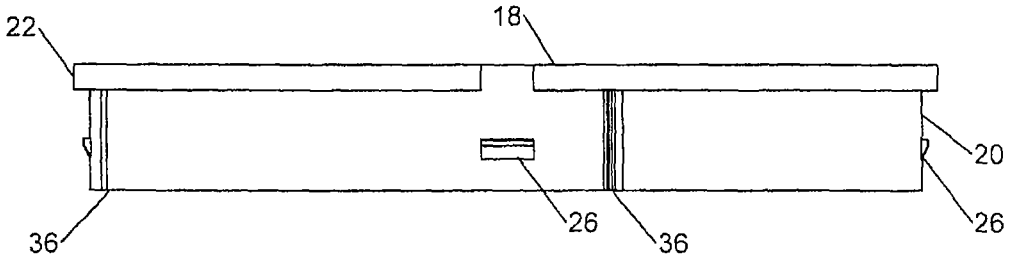
FIG. 6 is a side elevation of the end ring of FIG. 5.
Figure 7:
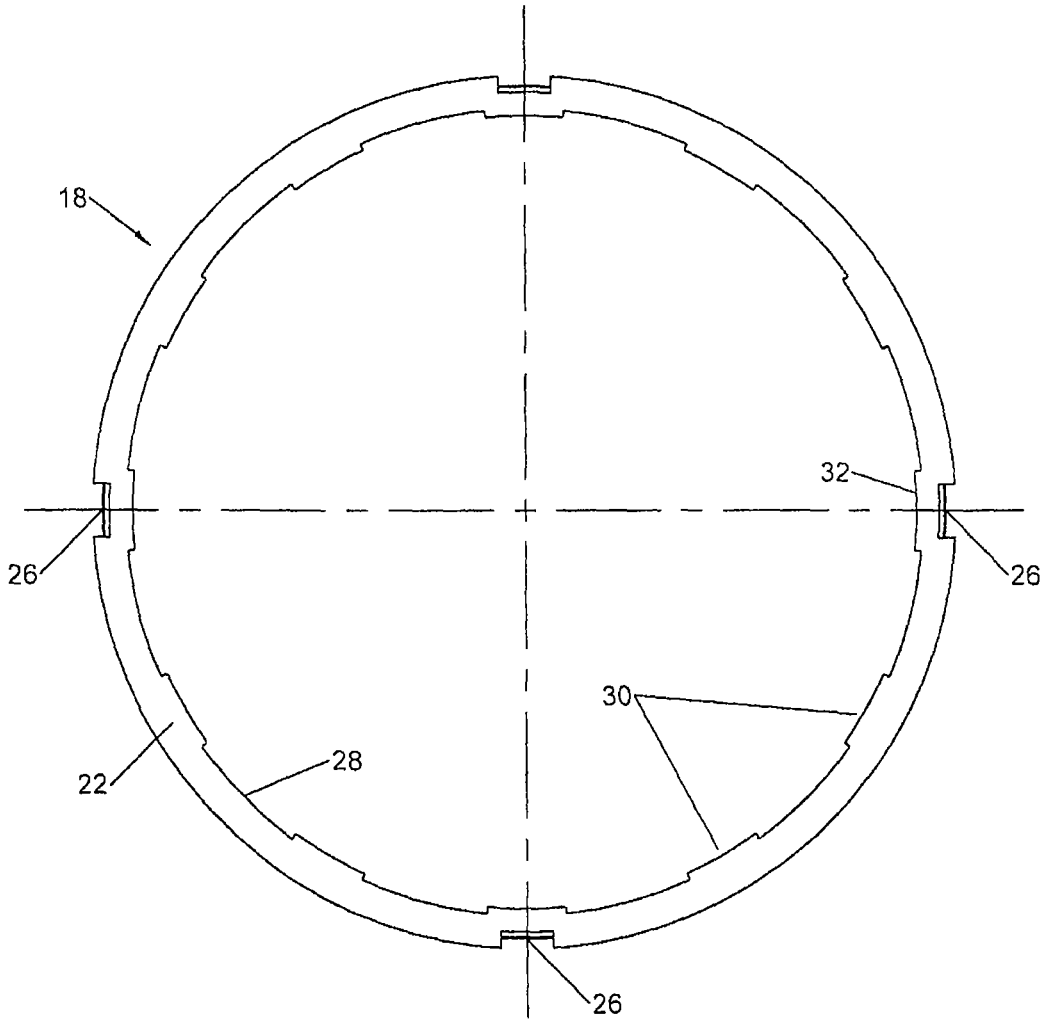
FIG. 7 is a plan view of the end ring of FIG. 6.

Still further, each end 16 of the body 12 is provided with an end ring 18 formed of plastics material. As shown in FIGS. 5 to 7, each end ring 18 comprises an annular member 20 having a generally smooth outer surface which is arranged to engage with an inner surface of the wall section 17 of an end 16. As shown in FIG. 3 the inner surface of the body 12 at the inner end of each wall section 17 provides a seat 19 arranged to engage with an annular member 20.

Preferably, the body 12 and each end ring 18 are formed from the same plastics material. In any event, the plastics material of each end ring 18 has a Youngs modulus no greater than that of the tubular body 12.

Further, each end ring 18 has an outer annular portion 22 of larger external dimension than the annular member 20. The annular portion 22 is arranged to engage with an outer end of a wall section 17 of the tubular body 12 in use.

Further, each end of the tubular body 12 is provided with at least one aperture 24 which is arranged to engage with a corresponding projection 26 on the annular member 20 of a respective end ring 18. Preferably, there are provided a plurality of apertures 24 equiangularly spaced with corresponding projections 26. Most preferably, there are provided four apertures 24 and corresponding projections 26 spaced at 90° to one another.

Figure 8:
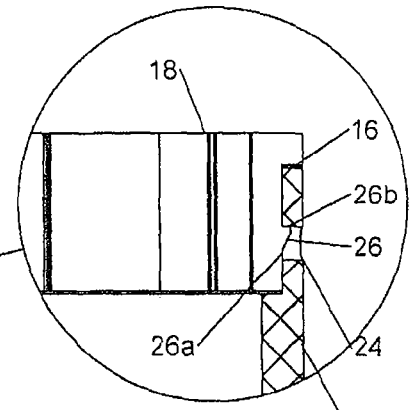
FIG. 8 is an enlarged view of part of FIG. 4 showing in detail an interconnection between an end ring and the tubular body.
Figure 4:
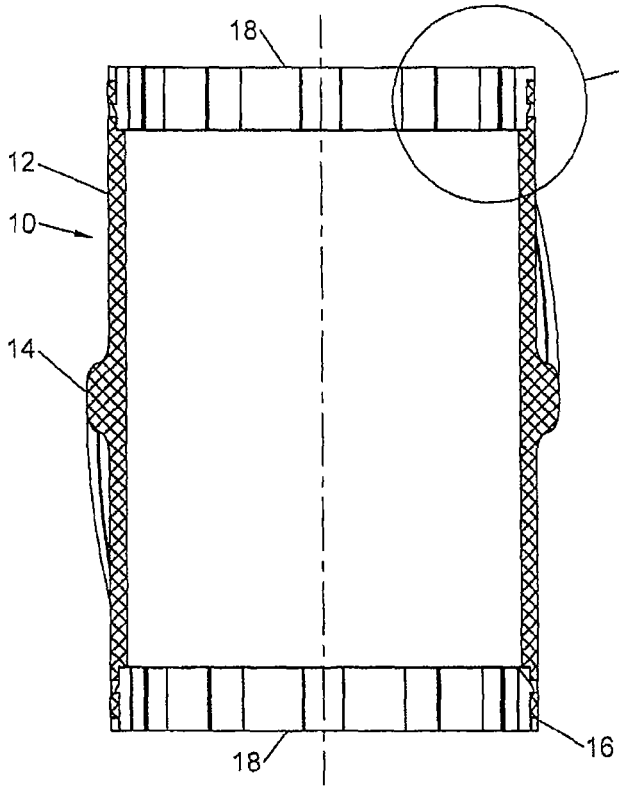
FIG. 4 is a cross-sectional view similar to FIG. 3 showing first and second end rings installed.

A preferred arrangement of a projection 26 engaging with an aperture 24 is shown in FIG. 8. It can be seen that the projection 26 has a tapered lower end **26*a* which becomes progressively smaller downwardly until it merges with the annular member 20. The project 26 shown in FIG. 8 has an angular upper end 26*b* which is disposed substantially at right angles to the annular member 20. In this way the end ring 18 may be readily engaged with an end 16 of the tubular body 12 but is more difficult to remove such that the risk of inadvertent dislodgement of the end ring 18** is reduced.

In that connection each annular member 20 has a small degree of resilience enabling it to be urged inwardly upon engagement with the tubular body 12 until a projection 26 reaches an aperture 24 at which point the annular member 20 springs outwardly so that the projection 26 and an aperture 24 interengage with one another. In this way the end ring 18 is more securely and positively engaged with the body 12 compared to relying on an interference fit alone.

Further, each end ring has an inner face 28 which may be provided with a plurality of inwardly extending projections 30. The projections 30 preferably are generally flat but have curved inner surfaces 32. The projections 30 are arranged to bear on, in use, a tubular about which the centraliser 10 is mounted.

Further, as shown in FIG. 1, the tubular body 12 is provided with alignment and anti-rotation means in the form of a plurality of equiangularly spaced longitudinal ribs 34 provided on an internal surface adjacent each end 16 and corresponding slots 36 in an outer face of the annular member 20 of each end ring 18.

In use, as a tubular drill string is assembled at least one centraliser 10 is mounted about each length of the tubular member before the tubular member is lowered into the casing of the well being drilled.

The centralisers 10 are arranged to be rotatably mounted on the drill string and to be freely slidable therealong between set points.

Further, the blades 14 are arranged to engage with the casing of the well so that the tubular members are laterally constrained within the casing by engagement of the centraliser 10 with the casing on the one hand and the tubular members on the other hand.

Modifications and variations as would be apparent to a skilled addressee are deemed to be within the scope of the present invention. For example, the blades 14 may be extended further so as to form part of the end rings 18.

The invention claimed is:

1. A downhole centraliser arranged to receive a downhole tubular, the centralizer comprising:

a tubular body having opposed ends and being formed of plastics material; and at least one end ring mounted to an end of the tubular body, the or each end ring also being formed of a plastics material and having a Youngs modulus no greater than that of the tubular body, at least one end of the tubular body having a relatively thin wall section arranged to receive an end ring wherein, the or each end ring comprises an annular member arranged to engage with an inner surface of a relatively thin annular wall section, the or each relatively thin wall section of the tubular body being provided with a plurality of spaced projections or apertures and the or each annular member being provided with a corresponding plurality of spaced apertures or projections, each aperture being arranged to engage with a corresponding projection such that the end ring and the body are positively engageable.

2. A downhole centraliser according to claim 1, wherein a respective end ring is mounted to each of the opposed ends of the tubular body.

3. A downhole centraliser according to claim 1, wherein the tubular body and the or each end ring are formed of the same plastics material.

4. A downhole centraliser according to claim 1, wherein the or each end ring is engaged with the tubular body by means of an interference fit.

5. A downhole centraliser according to claim 1, wherein the or each end ring is positively engageable with the tubular body in a releasable manner.

6. A downhole centraliser according to claim 1, wherein the or each end ring has an inner face formed with a plurality of spaced inward extending projections which are arranged in use to bear on a tubular member about which the centraliser is mounted.

7. A downhole centraliser according to claim 1, wherein there is provided a seat at an inner end of the thin wall section for engagement with the annular member.

8. A downhole centraliser according to claim 1, wherein the or each end ring has a small degree of resilience enabling it to be urged inwardly upon engagement with the body and then springing outwardly upon release.

9. A downhole centraliser according to claim 1, wherein the or each end ring and the tubular body are provided with cooperating alignment and anti-rotation means.

10. A downhole centralizer according to claim 9, wherein the cooperating alignment and anti-rotation means comprise a plurality of spaced slots on one member and a corresponding plurality of spaced ribs on the other member, corresponding said slots and ribs being arranged to be interengaged.

11. A downhole centralizer according to claim 1, wherein the downhole centralizer is substantially rigid.

12. A downhole centralizer according to claim 1, wherein the or each end ring is provided with a plurality of spaced projections whilst the or each inner wall section is provided with a corresponding plurality of spaced apertures.

13. A downhole centralizer according to claim 12, wherein the or each projection is asymmetrical in having a tapered inner portion and an angular outer portion.

14. A downhole centraliser arranged to receive a downhole tubular, the centralizer comprising:

a tubular body having a first end with a thinned wall section and an inner surface, the tubular body being formed of a first plastics material, the inner surface having a plurality of spaced radial projections or apertures; and a first annular end ring having an outer surface, the first annular end ring being formed of a second plastics material, the first annular end ring having a Youngs modulus no greater than a Youngs modulus of the tubular body, the outer surface having a corresponding plurality of spaced radial apertures or projections, wherein the first annular end ring is mounted to the first end of the tubular body with the plurality of spaced radial projections or apertures of the inner surface positively engaging the corresponding plurality of spaced radial apertures or projections of the outer surface.

15. A downhole centraliser according to claim 14, wherein the tubular body further comprises a second end with the thinned wall section and the inner surface having the plurality of spaced radial projections or apertures, and further comprising a second annular end ring having the outer surface with the corresponding plurality of spaced radial apertures or projections, the second annular end ring being mounted to the second end of the tubular body with the plurality of spaced radial projections or apertures of the inner surface positively engaging the corresponding plurality of spaced radial apertures or projections of the outer surface.

16. A downhole centraliser according to claim 14, wherein the first and second plastic materials are a common plastics material.

17. A downhole centraliser according to claim 14, wherein the first annular end ring forms an interference fit with the first end of the tubular body.

18. A downhole centraliser according to claim 14, wherein the first annular end ring is releasably mounted to the first end of the tubular body.

19. A downhole centraliser according to claim 14, wherein the inner surface of the first end further comprises a seat for engagement with the first annular end ring.

20. A downhole centraliser according to claim 14, wherein the inner surface of the first end further comprises a plurality of spaced axial slots or ribs and the outer surface of the first annular end ring comprises a corresponding plurality of spaced axial slots or ribs, the plurality of spaced axial slots or ribs of the inner surface positively engaging the corresponding plurality of spaced axial slots or ribs of the outer surface.

* * * * *